US005927128A

United States Patent [19]

Pithan et al.

[11] Patent Number: 5,927,128

[45] Date of Patent: Jul. 27, 1999

[54] ROLL STAND ARRANGEMENT FOR SINGLE STRAND ROLLING

[75] Inventors: Gerhard Pithan; Rüdiger Grimmel, both of Netphen; Karl Keller, Hilchenbach, all of Germany

[73] Assignee: SMS Schloemann-Siemag Aktiengesellschaft, Düsseldorf, Germany

[21] Appl. No.: 08/862,743

[22] Filed: May 23, 1997

[30] Foreign Application Priority Data

Jun. 1, 1996 [DE] Germany ..... 196 22 155

[51] Int. Cl.[6] ..... B21B 13/12; B21B 13/08

[52] U.S. Cl. ..... 72/235; 72/234

[58] Field of Search ..... 72/235, 237, 238, 72/244, 240, 248, 249, 234

[56] References Cited

U.S. PATENT DOCUMENTS 4,537,055 8/1985 Woodrow et al. ..... 72/235

5,577,405 11/1996 Shore et al. ..... 72/235

FOREIGN PATENT DOCUMENTS 0764480 3/1997 European Pat. Off. .

*Primary Examiner*—Joseph J. Hail, III
*Assistant Examiner*—Rodney Butler
*Attorney, Agent, or Firm*—Friedrich Kueffner

[57] ABSTRACT

A block-type roll stand arrangement for single strand rolling including roll stand housings mounted on a support structure. The roll stand housings are all of the same construction and each receives a pair of roll support shafts and the drive gear units therefor. The roll stand housings are arranged one behind the other with the roll support shafts being alternatingly inclined at an angle relative to the rolling line. Stiffening ribs are arranged between the plate support members. The stiffening ribs are connected to the side surfaces of the plate support members and to the base plate. The stiffening ribs may be composed of angle sections with a symmetrical angle cross-section, wherein the parallel outer edges of the angle sections rest on the base plate and whose angle-shaped front and rear side edges rest against the side surfaces of the plate support members.

7 Claims, 1 Drawing Sheet

ROLL STAND ARRANGEMENT FOR SINGLE STRAND ROLLING

BACKGROUND OF THE INVENTION

1. Field of the Invention

The present invention relates to a block-type roll stand arrangement for single strand rolling including roll stand housings mounted on a support structure. The roll stand housings are all of the same construction and each receives a pair of roll support shafts and the drive gear units therefor. The roll stand housings are arranged one behind the other with the roll support shafts being alternatingly inclined at an angle relative to the rolling line.

2. Description of the Related Art

Roll stand arrangements of this type are used, inter alia, as finishing sections in wire rolling mills which are operated continuously at very high rolling speeds. Accordingly, the support structure of the roll stand arrangement must have a high stiffness in longitudinal and transverse directions and must be resistant to vibrations to a high degree, so that the quality of the wire travelling through the roll stand arrangement is ensured with respect to cross-sectional dimensions and surface properties.

In a roll stand arrangement disclosed in EP-B1-165 673, the support structure is composed of a single-piece, relatively heavy steel plate as a base plate, wherein a vertically extending additional steel plate as a web plate is welded onto the steel plate to form an inverted T-cross-section. A plurality of pairs of plate support members are placed vertically on the base plate, wherein the plate support members rest with their vertical side edges alternatingly against one or the other of the side surfaces of the web plate and the plate support members are welded to the web plate and to the base plate. The plate support members have support surfaces extending in pairs parallel and at an angle to the horizontal, wherein side flanges are placed on the support surfaces, and wherein the side flanges are arranged on the sides of the roll stand housing and can be screwed to the plate support members.

This support structure for the roll stand arrangement has a relatively high weight because of the large amount of material required for the base plate and the web plate.

SUMMARY OF THE INVENTION

Therefore, it is the primary object of the present invention to provide a support structure of the above-described type which uses significantly less material and, thus, is of lighter weight and which provides additional advantages for the rolling operation.

In accordance with the present invention, the above object is met by arranging between the plate support members stiffening ribs which are connected to the side surfaces of the plate support members and to the base plate.

The stiffening ribs may be composed of angle sections with a symmetrical angle cross-section, wherein the parallel outer edges of the angle sections rest on the base plate and whose angle-shaped front and rear side edges rest against the side surfaces of the plate support members. The outer surfaces of the angle sections extend at a distance from the outer surfaces of the roll stand housings which are placed on the plate support members.

In accordance with another feature of the present invention, the support surfaces of the plate support members are located in a plane extending parallel to the horizontal rolling center plane, and the side flanges of the roll stand housings are each composed of two side flange portions extending at a right angle relative to each other.

Finally, in accordance with another feature of the invention, the angle sections are arranged so that the upper ridges thereof extend parallel to and underneath the rolling line and act as deflection plates for the sinter run-off.

As compared to the conventional support structure, the connection of the plate support members to the roof-shaped angle sections constitutes a compact and very light-weight support structure for the roll stand arrangement which is extremely stiff with respect to bending and the connections; this is not only true because the web plate necessary in the known construction is not used, but also because the base plate can be of significantly lighter construction. In addition, an excellent discharge of the sinter run-off is ensured without requiring additional structures.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
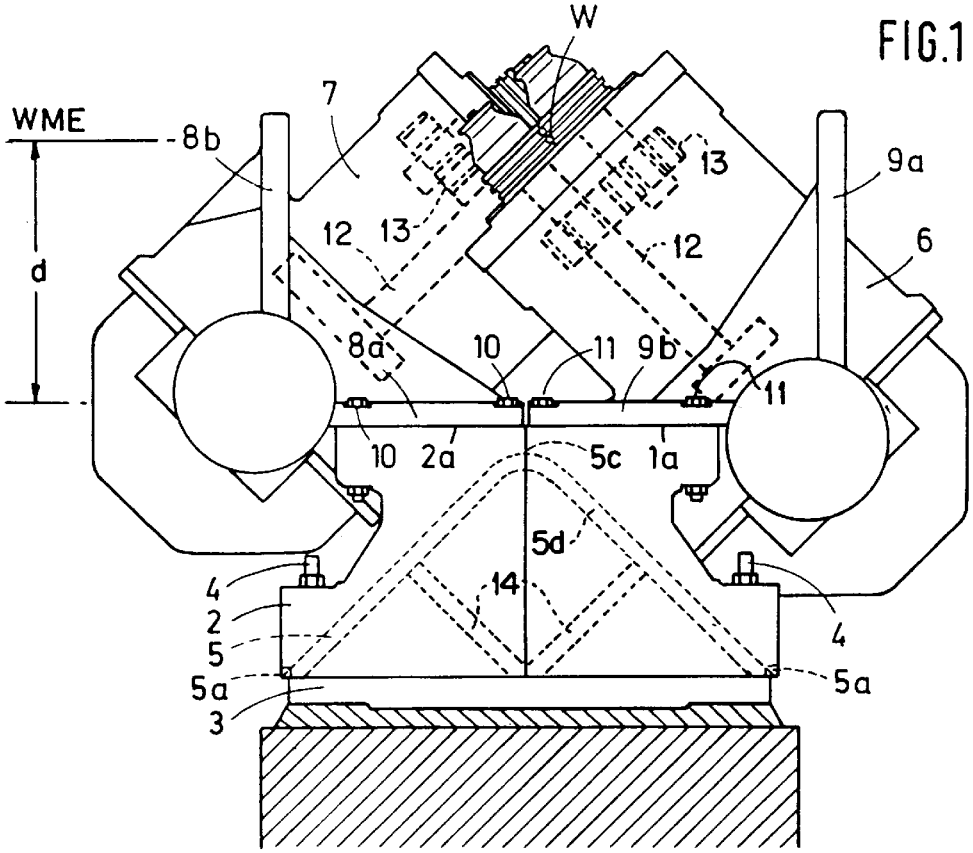
FIG. 1 is a schematic side view of the roll stand arrangement according to the present invention seen in rolling direction.

As shown in FIG. 1, the block-type roll stand arrangement for single strand rolling according to the present invention includes roll stand housings 6 and 7 each provided with a pair of roll support shafts 12 and drive gear units 13 therefor.

Figure 2:
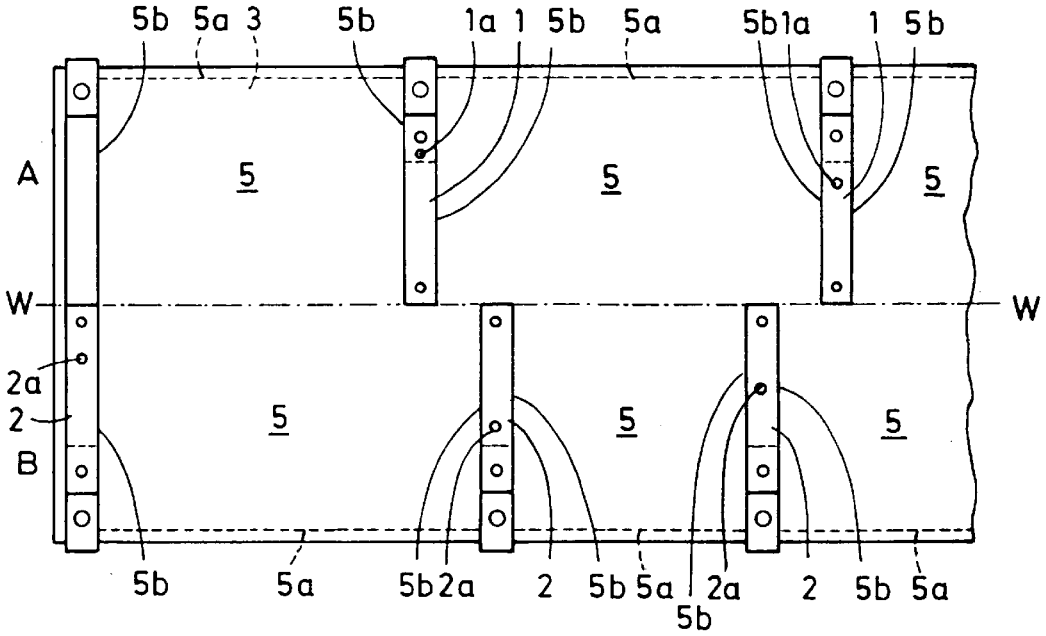
FIG. 2 is a schematic partial top view of the support structure of the roll stand arrangement.

As shown in FIGS. 1 and 2 of the drawing, the pairs of plate support members 1,1 and 2,2 are offset relative to each other by a certain extent in the rolling line W and are arranged on the base plate 3 alternatingly on one and the other side A,B of the rolling line W. The plate support members are connected to the base plate 3 by means of bolts and screws 4.

Between the pairs of plate support members 1,1 and 2,2 are arranged angle sections 5 having symmetrical angle cross-sections, wherein the outer edges 5*a* of the angle sections 5 rest on the base plate 3 and are connected thereto by welding. The front and rear side edges 5*b* of the angle sections 5 rest against and are also welded to the side surfaces of the plate support members 1.

As seen particularly in FIG. 1, on the sides of the roll stand housings 6 and 7 are arranged two side flange portions 9*a*, 9*b* and 8*a*, 8*b*, respectively, which extend at a right angle relative to each other and which rest alternatingly on the support surfaces 1*a* and 2*a*, respectively, of the plate support members 1 and 2, respectively, and are connected thereto by means of screws 10 and 11. The support surfaces 1*a* and 2*a* are located in a plane extending parallel to and by a distance d underneath the horizontal rolling center plane WME. As can be seen in the drawing, the outer surfaces of the angle sections 5 extend at a distance from the outer surfaces of the roll stand housings 6 and 7 placed on the plate support members 1 and 2, respectively, and the upper ridge 5*c* of each angle section extends underneath the rolling line W, so that the sinter formed in this area drops onto the outer surfaces of the angle sections 5 and is deflected toward both sides by means of the outer surfaces of the angle sections 5.

The angle section 5 can also be composed of individual plates whose side edges are welded together in the appropriate manner, not shown.

It is possible to cast a solidifying material, for example, hard concrete into the hollow spaces formed by the angle sections 5, the base plate 3 and the plate support members 1,2. Reinforcement members 14 connected to the inner surfaces 5*b* of the angle sections 5 maybe provided for reinforcing the concrete. This measure not only increases the stability of the support structure, but any possible vibrations are dampened and droning effects are avoided.

While specific embodiments of the invention have been shown and described in detail to illustrate the inventive principles, it will be understood that the invention may be embodied otherwise without departing from such principles.

We claim:

1. A block-type roll stand arrangement for single strand rolling in a rolling line, the roll stand arrangement comprising roll stand housings mounted on a support structure, the roll stand housings being of identical construction and each receiving a pair of roll support shafts and drive gear units therefor, the roll stand housings being arranged one behind the other with the roll support shafts being alternatingly inclined at an angle relative to the rolling line, the support structure comprising a base plate and a plurality of pairs of plate support members vertically mounted on the base plate and having support surface, side flanges being attached to opposite sides of each roll stand housing, the side flanges being releasably attached to the support surface of the plate support members, further comprising stiffening elements arranged between the plate support members, the plate support members having side surfaces facing side surfaces of adjacent plate support members wherein the stiffening elements are comprised of angle sections each having a symmetrical cross-section, the angle sections having parallel outer edges and angle-shaped front and rear side edges, wherein the outer edges of the angle sections rest on and are connected by welding to the base plate and the front and rear side edges rest against and are connected by welding to the side surfaces of the plate support members.

2. The roll stand arrangement according to claim 1, wherein the angle sections and the roll stand housings each have outer surfaces, and wherein the outer surfaces of the angle sections extend at a distance from the outer surfaces of the roll stand housings.

3. The roll stand arrangement according to claim 1, wherein the support surfaces of the plate support members are located in a plane extending parallel to a horizontal rolling center plane, and wherein the side flanges of the roll stand housings are each comprised of two side flange portions extending at a right angle relative to each other.

4. The roll stand arrangement according to claim 1, wherein each angle section has an upper ridge, wherein the angle sections are arranged with the upper ridges thereof extending parallel to and underneath the rolling line, whereby the angle sections act as deflection plates for sinter run-off.

5. The roll stand arrangement according to claim 1, further comprising a solidifying cast material filled into hollow spaces formed by the angle sections, the base plate and the plate support members.

6. The roll stand arrangement according to claim 5, wherein the cast material is concrete.

7. The roll stand arrangement according to claim 5, further comprising reinforcement members for reinforcing the cast material, wherein the reinforcement members are connected to inner surfaces of at least one of the angle sections, the base plate and the plate support members.

* * * * *